United States Patent [19]

Peppers

[11] 4,315,797

[45] Feb. 16, 1982

[54] CHEMICAL PIPE CUTTER WITH EXPONENTIAL SPACING BETWEEN REACTANT STAGES

[75] Inventor: James M. Peppers, Houston, Tex.

[73] Assignee: Gearhart Industries, Inc., Fort Worth, Tex.

[21] Appl. No.: 155,542

[22] Filed: Jun. 2, 1980

[51] Int. Cl.[3] ..... C23F 1/02; E21B 29/02

[52] U.S. Cl. ..... 156/654; 156/345; 156/664; 166/55.2; 166/63

[58] Field of Search ..... 156/654, 664, 640, 345; 175/2; 431/202, 207; 166/55, 55.2, 63, 164, 169, 297, 298; 60/632; 123/19, 24 A, 57 R

[56] References Cited

U.S. PATENT DOCUMENTS

| | | | |
|---|---|---|---|
| 2,526,695 | 10/1950 | Schlumberger | 166/55.2 |
| 3,076,507 | 2/1963 | Sweetman | 166/55.2 |
| 3,115,932 | 12/1963 | Reynolds | 166/63 |
| 3,174,547 | 3/1965 | Fields | 166/63 |
| 4,180,131 | 12/1979 | Chammas | 166/55 |

*Primary Examiner*—Jerome W. Massie
*Attorney, Agent, or Firm*—James M. Peppers

[57] ABSTRACT

Discloses an improved tool and method for cutting material by expelling a jet stream of liquid chemical reactant into forceful flowing connection and chemical reaction with a designated area of the material. Applies a continuing force to a designated first stage mass of reactant to move the first mass through a designated linear distance to accelerate the first mass and thereby provide the first mass with kinetic energy. Causes the first mass to encounter and join with a second stage mass of chemical reactant to form an aggregate mass with the aggregate mass then moving at a velocity attained by the kinetic energy of the first mass, as applied to the aggregate mass, and at a rate of acceleration generated by the continued application of said force to the aggregate mass. Passes the aggregate mass through a medium adapted to heat the said aggregate reactant mass to a substantially elevated temperature. Directs the flow of the aggregate mass as heated through at least one jet orifice into flowing connection with material to be cut at a velocity sufficiently great to continually flush the interface connection between the reactant and the material substantially clean of any reaction products as would cause a diminished chemical reaction between the material and the reactant. More spaced apart stages of reactant may be provided.

6 Claims, 1 Drawing Figure

CHEMICAL PIPE CUTTER WITH EXPONENTIAL SPACING BETWEEN REACTANT STAGES

BACKGROUND OF THE INVENTION

This invention generally pertains to methods and apparatus for cutting or perforating conduit in a well bore and more particularly for cutting into well bore conduit with chemical reaction from fluid jets of a tool suspended from a wireline.

DISCUSSION OF THE PRIOR ART

Of the known prior art, U.S. Pat. Nos. 2,918,125, 3,076,507, and 4,125,161 disclose structure generally germane to the structure of the present invention, particularly that shown in FIG. 7 of U.S. Pat. No. 3,076,507, where three spaced apart chemical fluid containers are provided with fluids to carry out cleaning, cutting, and enlarging operations as therein disclosed. The information in these patents is useful as a background for the present description and accordingly are hereby incorporated by reference.

Whenever stuck drill pipe has to be cut to be freed or tubing is cut to be recovered, experience has shown that the cut produced by the chemical cutter offers the least trouble, smallest overall expense and the highest success in the recovery operation. This is because the cut is not flared, has no burrs, and the inside and outside diameters around the cut are not changed. The overshot used in recovery operations can be easily placed over the cut string without milling.

Additionally, the chemical cutter leaves no debris in the well. The halogen fluoride reactant used in the cutter produces a chemical reaction that dissolves the pipe in the cut area. Since no part of the cutter is expendable, there is no debris.

It has been found, experimentally, that the rate at which the halogen fluoride is expelled from the tool greatly effects the standoff capability and cutting capability of the tool.

The distance of clearance between the outside diameter of the cutting head and the inside diameter of the tubing, pipe or casing which is being cut is termed "standoff." It is extremely desirable that the standoff capability of the tool be as great as possible. That is, a large standoff capability allows the tool to be run through smaller diameter restrictions to make a cut from within a pipe of given I.D.

The standoff capability of a chemical cutter is a basic characteristic that determines its competitive superiority.

As noted in the referenced prior art, extremely active chemical reactants such as the powerful $HF_3$, for example, are used to cut or perforate through the walls of well conduit. Other very active reactants are Fluorine, $ClF_3$, $BrF_3$, and similar fluorine compositions.

In the cutting process the reactant or reagent is passed through a heating "pre-ignition" medium which serves to preheat the reactant, extremely active initially, into its most active reactive state, the state of being essentially an "incendiary" cutting agent; however, the most important reaction in severing the tubing is an actual chemical reaction.

Then, the heated incendiary fluid is forced under high pressure through a jet orifice into flowing contact or connection with the conduit or similar object of reactable material to be cut, iron or steel for example.

OBJECTS OF THE INVENTION

The principal object of the invention is to provide a fluid jet type chemical cutting or perforating tool which will project or propell a liquid chemical reaction agent from a fluid jet as greater kinetic energy than heretofore attained with the force of the same propellants; with the same total quantity of chemical reactant; and with an optimum reduced total lineal distance for the total reaction agent to be moved from a starting position to becoming a jet stream.

SUMMARY OF THE INVENTION

In summary, an improved method of cutting material by expelling a jet stream of liquid chemical reactant into forceful flowing connection with a designated area of said material is disclosed with the steps of applying continued force to a designated first stage mass of reactant to move said first mass through a designated linear distance to accelerate said first mass and to provide said first mass with kinetic energy; causing said first stage mass to encounter and join with a second stage mass of chemical reactant to form an aggregate mass with said aggregate mass then moving at a velocity attained by the kinetic energy of said first mass applied to said aggregate mass and at a rate of acceleration generated by the continued application of said force to move said aggregate mass; causing said aggregate mass to encounter and join with a third stage mass of chemical reactant to form an enlarged aggregate mass with said aggregate mass then moving at a velocity attained by the kinetic energy of said aggregate mass as applied to said enlarged aggregate mass and at a rate of acceleration generated by the continued application of said force to move said enlarged aggregate mass; passing said enlarged aggregate mass through a medium adapted to heat the reactant of said enlarged aggregate mass to a substantially elevated temperature; and directing the flow of said enlarged aggregate mass as heated through at least one jet orifice into flowing connection with said material at a velocity sufficiently great to continually flush the connection interface of said reactant and said material substantially clean of such reaction products as could cause a diminishment of chemical reaction between said material and said reactant.

DESCRIPTION OF THE PREFERRED EMBODIMENT

Figure 1:
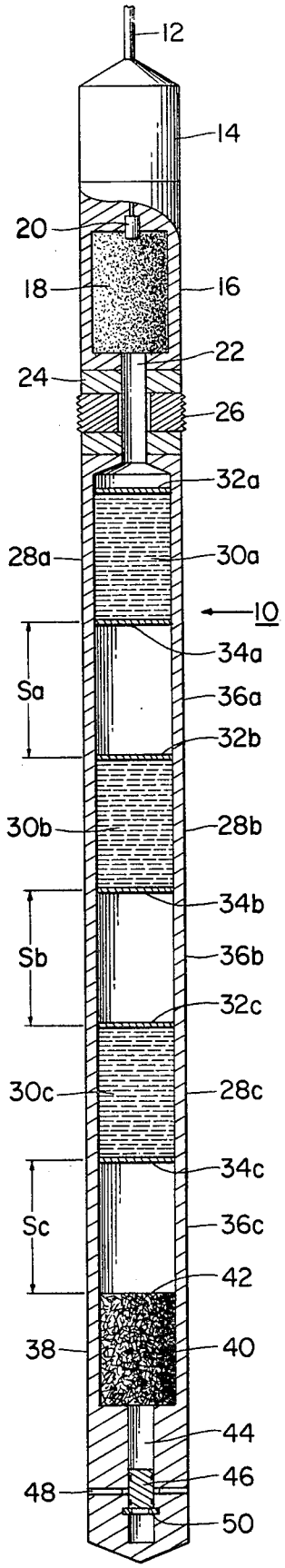
FIG. 1 is an elevational sectional view showing a chemical cutting tool of the present invention with a propellant assembly at its top in communication with a lower pipe anchor assembly and in further communication a body containing a plurality of stages of chemical reactant masses interspaced with cavities of linear or longitudinal distance and a chamber containing a reactant treating composition disposed above cutting jets.

The tool 10 as shown in FIG. 1 is suspended from a cable 12 in a well tubing (not shown) of internal diameter slightly larger in the outside diameter of tool 10. Beginning at the top of tool 10, there is provided a section 14 which may house a casing collar locator and also the testing and firing circuits (not shown) for the ignitor 20 as later described.

Below the housing 14 is connected a power section 16 containing a propellant 18 adapted for ignition by an electrical ignitor 20.

A passage 22 extends downwardly from the power section 16 into an anchor assembly 24 in which are mounted a plurality of casing or internal gripping slips 26 adapted to be extended by fluid pressure and returned by springs (not shown), for example.

Connected below the anchor assembly 24 are a series of chambers in communication with passage 22 with the first being a first stage chemical reactant chamber 28 containing a reactant 30 housed within the chamber 28 by upper and lower rupture diaphrams 32*a* and 34*a*.

Mounted below the reactant chamber 28*a* is a second stage reactant chamber 28*b* containing a reactant 30*b* confined by upper and lower rupture diaphrams 32*b* and 34*b* respectively.

Positioned between the chambers 28*a* and 28*b* is an air chamber section 36*a* of linear or longitudinal dimension providing a spacing Sa between the lower diaphram 34*a* of container 28*a* and diaphram 32*b* of container 28*b*.

Below the chemical chamber 28*b* may be a third stage reactant chamber 28*c* containing a chemical reactant 30*c* confined by rupture diaphrams 32*c* and 34*c*.

Disposed between the chambers 28*b* and 28*c* may be another air chamber 36*b* providing a distance of Sb between the lower diaphram 34*b* of chamber 28*c* and diaphram 32*c* of chamber 28*c*.

Though not shown, additional stages reactant chambers 28 and corresponding air chambers 36 may be provided as desirable.

Below the chamber 28*c* is a reactant heating chamber 38 containing a treating material 40 which will serve to react with the cutting reactant and heat the cutting reactant to a designated elevated temperature, giving the reactant extremely high chemical activity.

Disposed between the heating chamber 38 and the reactant chamber 28*c* may be another air chamber 36*c* providing a distance Sc between the lower diaphram 34*c* of reaction chamber 28*c* and an upper face 42 of the treating material 40.

In the schematic drawing as shown, the distances Sa, Sb, and Sc are substantially equal. However, unequal spacing is provided by this invention as later described.

A passage 44 opens out below the chamber 38. Mounted within slidable relation within passage 44 is a jet release plug 46 which, when in its upper position, covers a plurality of cutting jets 48 in sealed relation. The jet release plug 46 is releasably supported in its upper position by a shear washer 50 mounted in the passage 44 below the plug 46.

A designated force imposed from above plug 46 will cause the shear washer 50 to shear and allow the plug 46 to be moved down in the passage 44 and thereby uncover the cutting jets 48 to permit fluid flow through jets 48 into flowing connection with the inner wall of pipe (not shown), for example.

It is to be noted, that while the tool shown is provided with at least three stages of reactant chambers 28*a*, 28*b*, and 28*c*, that more stages of acid chambers can be provided within the spirit of the invention.

It is also to be noted, that in the embodiment shown, the diaphram 34*c* may be provided immediately disposed at or near the upper face 42 of the treating material 40 with the chamber 36*c* substantially eliminated, and also come within the spirit of the present invention.

The chemical reactant preferred for the chemical cutter of the present invention is bromine trifluoride ($BrF_3$). It is a heavy, low viscosity, amber-colored transparent fluid at all normal above-ground temperatures. It will very quickly react with water, oil, and most finely divided materials with a star-like flame. It will not detonate or explode due to shock or temperature.

In a tool of this kind, the driving force for driving the reactant through the jetting nozzles is the confined burning of a relatively slow burning propellant of the general kind used in rifles such as military artillary.

The treating material may be a commercial grade steel wool or oil coated fiberglass wool, as examples.

It is desirable that as much as possible of the halogen fluoride be ejected at an optimum flow rate. It is also desirable to reach this flow rate in the most efficient manner to minimize turbulance within the cutting tool.

In effect, the optimum flow rate should be attained with the smallest driving force, which is usually a gas created by burning power pellets, and within a cutting tool of minimum size in terms of its length and diameter.

An immediate and extremely rapid reaction is caused between the incendiary reactant and the object being cut, steel in the case of a well conduit. The chemical reaction is so rapid that the reaction products, such as fluorides of iron for example, is postulated to build up at the interface of the reaction. This build-up of reaction products must be removed to permit the reactant subsequently to come further into chemically reactive contact with the metal surface.

In the reaction process of the present invention, the reaction products are removed by the hydraulic jetting, cleansing and flushing action of the fluid reactant. Thus, with a specific kind and weight of reactant being delivered at a specific temperature and by a specific force, a higher flow velocity of the reactant will cause more rapid removal of the reaction products and thus permit additional metal to be exposed at a faster rate for reaction.

Now, if the halogen fluoride is staged in more than one storage compartment in the tool, this optimum flow rate is obtained in a mass acceleration and reaction fashion with the smallest driving force. In effect, the kinetic energy imparted to the halogen fluoride to produce the flow rate is maximized within the confines of a specific tool.

In example, when tool 10 is operated with a given gas pressure force, and the reactant mass modules are of designated weight, the general equation for acceleration will be:

Acceleration (a)=Force (F)÷(the weight (W)÷by 32.2); and, then time (t)=square root of (the square root of 2×the distance (s)÷by (a).

The velocity (v)=a×t; and

The kinetic energy (KE) is equal to $\frac{1}{2}$ (W÷32.2)×$V^2$.

Given, for example, that the F=10#, D=1′ and W=2#, then the KE of the 2# reactant mass is about 50 foot pounds.

In the above calculation, if W is increased to 4#, with the other factors the same, then KE calculates to be about 25 foot pounds for the 4# reactant mass.

Thus, it is seen, that with a designated Force of 10# bearing on a first mass of Weight of 2# through a distance of 1′, then kinetic energy is much greater than the same force moving a mass of weight of 4# through the same 1′ distance.

Correlating the foregoing to the present invention, if the force (assumed to be constant) is brought to bear on $\frac{1}{2}$ of the total mass of the reactant through a given distance to then pick up the other $\frac{1}{2}$ of the mass, then the kinetic energy (and velocity) developed will be substantially greater than that of moving the entire mass with the same force through the same distance.

The foregoing becomes more complex when more than two masses are disposed in space apart relation as shown in the drawing, but the principal remains the same, in that with a given force, more ultimate velocity is attained by moving part of the total mass through a given distance, then picking up more of the total mass after kinetic energy has been developed in the moving part of the mass through a given distance.

It is to be noted that the linear distances S within the air spaces as shown in FIG. 1, such as the distances Sa, Sb, and Sc, are to be other than equal. The spaces and distances between the reactant chambers are desirably exponential in character, rather than being equally spaced as shown, with Sb, Sc, etc., being progressively shorter than Sa. For example only, $Sb=\frac{2}{3}$ Sa, $Sc=\frac{2}{3}$ Sb, and so on as practicable.

It is also to be noted, that if the spacing between the stages of reactant masses are made in such exponential fashion, such spacing provides the development of maximum velocity within a given overall distance of travel of the aggregate mass. For the development of maximum velocity with uniform, or nearly uniform, force applied throughout the cycle, the velocity is developed to a maximum throughout the distance with a given force and a given aggregate mass. As a result, a maximum velocity and kinetic energy may be imparted to a specific total mass of reactant in a specific system by exponential spacing.

The foregoing may be compared somewhat to a railway engine which, when starting the train and neglecting static friction, starts the leading box car into motion, then picks up the successive box cars through the coupler slack between the cars, thus utilizing the kinetic energy of the moving cars.

OPERATION OF THE PREFERRED EMBODIMENT

In operation, the tool 10 is lowered down through a string of well tubing and positioned by a means of a depth indicator and a casing collar located within section 14 (not shown) to the level at which the tubing is to be cut off so that the upper portion of the cut tubing may be removed in total from the well.

After the tool 10 is positioned, the ignitor 20 is checked by a test circuit (not shown) in section 14 and thereon energized to ignite the propellant 18.

As the propellant 18 begins to burn, a gas pressure is developed which may be in the order of several thousand psi "real" pressure within tool 10, and which will be a lesser differential pressure between the inside and outside of tool 10, depending on the hydrostatic pressure of the well fluids at the depth where tool 10 positioned.

The increasing pressure extends the slips 26 into contact with the interior of the tubing and anchors the tool 10 in fixed position so that it may not move either upwardly or downwardly in the tubing during the cutting operation.

As the gas pressure developes to a magnitude sufficient to rupture the upper rupture diaphram 32*a* of the chamber 28*a*, this pressure is almost instantly transmitted through the reactant 30*a* to the rupture diaphram 32*a*, which also ruptures.

The propellant in power section 16 is continuing to burn and the pressure developed within the chamber remains high. The reactant 30*a*, responsive to the pressure from the propellant 18, is moved by the gas pressure force applied, such force being generally a function of the gas pressure and the cross sectional area of the interior of the chamber 28*a*.

The reactant 30*a* thereon moves downwardly through the chamber 36*a* at an acceleration and increasing velocity determined by the force of the gas pressure and the mass of the reactant.

After moving through the distance Sa, the reactant 30*a* encounters the upper diaphram 32*b* of the chamber 28*b* and almost instantly ruptures diaphram 32*b*, transmitting the force to the reactant 30*b* and to the diaphram 34*b*. Diaphrams 32*b* and 34*b* thereon rupture, and the reactants 30*a* and 30*b* continue to move as an aggregate mass until the reactant 30*b* encounters the upper diaphram 32*c* and the force is thereon transmitted through diaphrams 32*c*, reactant 30*c*, and diaphram 34*c*, rupturing these diaphrams and moving the then combined aggregate masses of reactants 30*a*, 30*b*, and 30*c* down through chamber 36*c* through a distance Sc into and through the face 42 into the treating material 40.

Within the treating chamber 38, the reactant coming into contact with the treating material 40 immediately reacts with the treating material, causing a very high rate of temperature increase which may be herein termed incendiary for the purpose of describing the state the reactant is in when it leaves the chamber 38. The reactant thereon continues down through the passage 44 and imposes the force from the reactant against the jet release plug 46 until the shear washer 50 has sheared, permitting the plug 48 to move down and expose the cutting jets 48.

The pressure developed by the propellant 18 remains at a high level and continues to increase slightly, depending on the temperature at which the propellant 18 is burning and the expanded space provided by movement of the reactants 30*a*, 30*b*, and 30*c*.

The very high pressure of the propellant gases forces the aggregate reactant mass 30, aided by the kinetic energy of the moving aggregate mass of reactant, out through the cutting jets 48 at very high velocity against the interior surface of the tubing to be cut.

The cutting action, or reaction, of the reactant with the metal of the tubing begins instantaneously upon contact of the reactant and the metal. The very high velocity of the reactant, in flowing connection with the metal, causes a cleansing and flushing action at the reaction interface of the reactant and the metal and carries away the reaction products as fast as such reaction products are formed.

Ideally, the reaction products of the reactant and the metal should be washed or flushed away as rapidly, or more rapidly, than the reaction is occurring. Such flushing is desirable even though all the reactant is not utilized in the reaction.

After the reactant is completely ejected from the tool 10, it is followed by the gases developed by the propellant 18 until such time as the gas pressure within the tool 10 and the hydrostatic fluid pressure outside the tool 10 becomes equal.

When the pressure inside and outside the tool 10 becomes equal, or very nearly equal, the slips 26 are resiliently retracted by spring means (not shown) and the tool 10 is free for withdrawal from the well.

The tool 10 is thereon pulled out of the well by means of a cable 12 and subsequently the tubing which has been cut is also removed from the well in a joint by joint fashion as commonly known in the art.

It is to be noted that other embodiments may differ somewhat from that shown herein, yet utilize the concept of the invention as specified in the appended claims.

I claim:

1. In an improved method of cutting material by expelling a jet stream of liquid chemical reactant into forceful flowing connection and chemical reaction with a designated area of said material, the steps comprising:

(a) applying a continuing force to a designated first stage mass of said reactant to move said first mass through a first linear distance to accelerate said first mass and thereby provide said first mass with kinetic energy;

(b) causing said first mass to encounter and join with a second stage mass of chemical reactant to form an aggregate mass with said aggregate mass then moving at a velocity attained by the kinetic energy of said first mass as applied to said aggregate mass and at a rate of acceleration generated by the continued application of said force to said aggregate mass through a second linear distance less than said first linear distance;

(c) causing said aggregate mass to encounter and join with a third state mass of chemical reactant to form an enlarged aggregate mass with said enlarged aggregate mass then moving at a velocity attained by the kinetic energy of said aggregate mass as applied to said enlarged aggregate and at a rate of acceleration generated by the continued application of said force to said enlarged aggregate mass;

(d) passing said enlarged aggregate mass through a medium adapted to heat the reactant of said enlarged aggregate mass to a substantially elevated temperature; and (e) directing the flow of said enlarged aggregate mass as heated as a jet stream into flowing connection with said material.

2. The method of claim 1 wherein the linear distance between said second stage mass of chemical reactant and each successive stage mass of reactant becomes progressively shorter than the distance between said first stage mass and said second stage mass.

3. The method of claim 1 wherein the relative linear distances between said first stage mass and at least two successive stage masses are designated to define an exponential curve if plotted on X-Y coordinates.

4. A tool including a liquid chemical reactant in combination for cutting material by expelling a jet stream of said reactant into forceful flowing connection with a designated area of said material, comprising:

(a) means for applying a continuing force to a designated first stage mass of said reactant housed within said tool to move said first mass through a first distance to accelerate said first mass and thereby provide said first mass with kinetic energy;

(b) said first mass being adapted to encounter and join with a second stage mass of chemical reactant housed within said tool to form an aggregate mass with said aggregate mass then moving at a velocity attained by the kinetic energy of said first mass as applied to said aggregate mass and at a rate of acceleration generated by the continued application of said force to move said aggregate mass within said tool;

(c) said aggregate mass being adapted to move through a second distance shorter than said first distances to encounter and join with a third stage mass of chemical reactant housed within said tool to form an enlarged aggregate mass with said enlarged aggregate then moving at a velocity attained by the kinetic energy of said aggregate mass as applied to said enlarged aggregate mass and at a rate of acceleration generated by the continued application of said force to move said enlarged aggregate mass within said tool;

(d) said enlarged aggregate mass being adapted to pass through a medium adapted to heat the reactant of said aggregate mass to a substantially elevated temperature; and (e) jet orifice means in said tool for directing the flow of said enlarged aggregate mass when heated as a jet stream into flowing connection with said material.

5. The tool of claim 4 wherein the successive distances between each of more than two of said stage masses becomes progressively smaller away from said first stage mass.

6. The tool of claim 4 wherein the relative linear distances between said first stage mass and at least two successive stage masses are designated to define an exponential curve if plotted on X-Y coordinates.

* * * * *